US005786119A

United States Patent [19]

Sorriero et al.

[11] Patent Number: 5,786,119

[45] Date of Patent: Jul. 28, 1998

[54] ELECTROPHOTOGRAPHIC ELEMENTS HAVING CHARGE TRANSPORT LAYERS CONTAINING HIGH MOBILITY POLYESTER BINDERS

[75] Inventors: Louis Joseph Sorriero; Marie B. O'Regan, both of Rochester; Paul Michael Borsenberger, Hilton, all of N.Y.

[73] Assignee: Eastman Kodak Company, Rochester, N.Y.

[21] Appl. No.: 584,502

[22] Filed: Jan. 11, 1996

Related U.S. Application Data

[60] Provisional application No. 60/002,662 Aug. 22, 1995.

[51] Int. Cl.[6] ..... G03G 5/047

[52] U.S. Cl. ..... 430/59; 430/96

[58] Field of Search ..... 430/58, 59, 96

[56] References Cited

U.S. PATENT DOCUMENTS

| | | | |
|---|---|---|---|
| 3,615,414 | 10/1971 | Light | 430/56 |
| 4,072,520 | 2/1978 | Rochlitz et al. . | |
| 4,175,960 | 11/1979 | Berwick et al. . | |
| 4,840,860 | 6/1989 | Staudenmayer et al. | 430/96 |
| 5,120,627 | 6/1992 | Nozomi et al. . | |
| 5,122,429 | 6/1992 | Sundararajan et al. . | |
| 5,130,215 | 7/1992 | Adley et al. . | |
| 5,162,485 | 11/1992 | Odell et al. . | |
| 5,232,800 | 8/1993 | Pavlisko et al. . | |
| 5,232,801 | 8/1993 | Rule et al. . | |
| 5,232,802 | 8/1993 | Rule et al. . | |
| 5,266,429 | 11/1993 | Sorriero et al. . | |
| 5,316,880 | 5/1994 | Pai et al. . | |

FOREIGN PATENT DOCUMENTS

| | | |
|---|---|---|
| 77593 | 4/1983 | European Pat. Off. . |
| 312469 | 4/1989 | European Pat. Off. . |
| 552740 | 7/1993 | European Pat. Off. . |
| 2-127654 | 5/1990 | Japan . |

OTHER PUBLICATIONS

Borsenberger, Paul M. and David S. Weiss. Organic Photoreceptors for Imaging Systems. New York: Marcel–Dekker, Inc. pp. 312–325, 1993.

Borsenberger, Paul M. and David S. Weiss. Organic Photoreceptors for Imaging Systems. New York: Marcel–Dekker, Inc. pp. 190–211, 1993.

Chemical Abstracts 113:221321, 1990.

"Electron Transport in Disordered Organic Solids" by Paul M. Borsenberger pp. 273–279, Oct. 1990.

*Primary Examiner*—Christopher D. Rodee

*Attorney, Agent, or Firm*—John R. Everett

[57] ABSTRACT

An electrophotographic element comprising a high mobility charge transport layer. The layer binder is a polyester according to formula I:

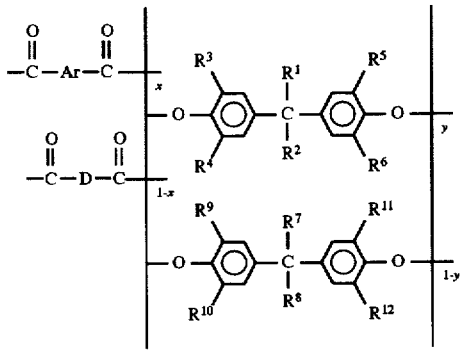

I wherein

Ar represents phenylene, terephthoyl, isophthoyl, 5-t-butyl-1,3-phenylene and phenylene indane;

D represents alkyl, linear or branched, or cycloalkyl, having from 4 to about 12 carbons;

$R^1$, $R^2$, $R^7$, and $R^8$ represent H, alkyl having 1 to 4 carbon atoms, cyclohexyl, norbornyl, phenylindanyl, perfluoralkyl having 1 to 4 carbon atoms, α, α-dihydrofluoroalkyl having 1 to 4 carbon atoms, and α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, halo and alkyl having from 1 to about 6 carbons;

x is from 0 to 0.8; and y is from 0 to 1.

4 Claims, No Drawings

ELECTROPHOTOGRAPHIC ELEMENTS HAVING CHARGE TRANSPORT LAYERS CONTAINING HIGH MOBILITY POLYESTER BINDERS

CROSS REFERENCE TO RELATED APPLICATION

Reference is made to and priority claimed from U.S. Provisional Application Ser. No. 60/002,662, filed 22 Aug. 1995, entitled ELECTROPHOTOGRAPHIC ELEMENTS HAVING CHARGE TRANSPORT LAYERS CONTAINING HIGH MOBILITY POLYESTER BINDERS.

1. Field of the Invention

The invention relates to electrophotographic elements.

2. Background of the Invention

Electrophotographic imaging processes and techniques have been extensively described in both the patent and other literature, for example, U.S. Pat. Nos. 2,221,776; 2,227,013; 2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a visible record of the electrostatic image.

A group of important electrophotographic elements used in these processes comprise a conductive support in electrical contact with a charge generation layer (CGL) and a charge transport layer (CTL) are known. The concept of using two or more active layers in electrophotographic elements, at least one of the layers designed primarily for the photogeneration of charge carriers and at least one other layer designed primarily for the transportation of these generated charge carriers are sometimes referred to as multilayer or multiactive electrophotographic elements. Patent publications disclosing methods and material for making and using such elements include: Bardeen, U.S. Pat. No. 3,401,166 issued Jun. 26, 1962; Makino, U.S. Pat. No. 3,394,001 issued Jul. 23, 1968; Makino et. al. U.S. Pat. No. 3,679,405 issued Jul. 25, 1972; Hayaski et. al., U.S. Pat. No. 3,725,058 issued Apr. 3, 1973; Canadian Patent No. 930,591 issued Jul. 24, 1973; and Canadian Patent Nos. 932,197–199 issued Aug. 21, 1973; and British Patent Nos. 1,337,228, 1,343,671. More recent publications include U.S. Pat. Nos. 4,701,396; 4,666,802; 4,427,139; 3,615,414; 4,175,960 and 4,082,551.

Charge transport layers have a binder in which a charge transport material is dispersed. The key requirement for the charge transport layer is that the photogenerated charges from the charge generation layer must not be deeply trapped (i.e. incapable of transport) and must transit the charge transport layer thickness in a time that is short compared to the time between the exposure and image development steps. This sets a lower limit for a parameter referred to as mobility or carrier drift velocity. These parameters are interrelated as follows:

$$v=\mu E$$

where v is the carrier drift velocity, μ is the mobility, and E is the electric field. (The fields that are normally used for electrophotography are between $2\times10^4$ and $5\times10^5$ V/cm.) For conditions of practical interest, the minimum mobility is in the range of a few multiples of $10^{-6}$ $cm^2/Vs$ in the field range of interest.

The choice of the transport layer polymer binder is based on several considerations: 1) it must be soluble in conventional coating solvents, 2) it must be miscible with the intended charge transport material at high concentrations, 3) it must be a good film former with appropriate physical and mechanical properties, 4) it must have be highly transparent throughout the intended region of the spectrum, and 5) it must provide for an acceptable charge mobility.

Polymers that have found widespread application in transport layers are limited to a few specific polycarbonates and polyesters. One polyester, poly[4,4'-norbornylidene bisphenylene terephthalate-co-azelate], provides a good combination of features for the just stated considerations. However it is relatively expensive, provides less than desirable mobility for charge transport materials, especially mixtures of charge transport materials.

SUMMARY OF THE INVENTION

The invention, in its broader aspects, provides an electrophotographic element comprising a charge generation layer and a charge transport layer having a binder according to formula I:

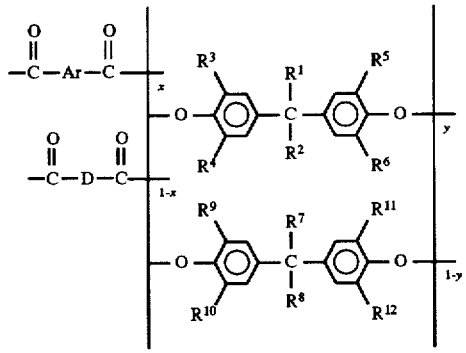

I wherein

Ar represents phenylene, terephthoyl, isophthoyl, 5-t-butyl-1,3-phenylene and phenylene indane;

D represents alkyl, linear or branched, or cycloalkyl, having from 4 to about 12 carbons;

$R^1$, $R^2$, $R^7$, and $R^8$ represent H, alkyl having 1 to 4 carbon atoms, cyclohexyl, norbornyl, phenylindanyl, perfluoralkyl having 1 to 4 carbon atoms, α, α-dihydrofluoroalkyl having 1 to 4 carbon atoms, and α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, halo and alkyl having from 1 to about 6 carbons;

x is from 0 to 0.8; and y is from 0 to 1.

It is an advantageous effect of at least some of the embodiments of the invention that are relatively inexpensive, exhibits enhanced scratch resistance and provides improved mobility for charge transport materials, especially mixtures of charge transport materials compared to the above mentioned prior art charge transport layer binder. Also with some embodiments the charge transport layer can be coated at a higher dry coverage while retaining superior sensitometric properties. This results in extended film process lifetime.

The mobilities of charge carriers in the polyesters used in the electrophotographic elements provided by this invention are surprising in that they are higher than the mobilities of the same materials in similar polyesters used in commercial electrophotographic elements. See polymer A in the examples. There is nothing in the art that would lead us to expect this increase in mobility since the structures of (A) and the polymers of the invention are similar.

DETAILS OF THE INVENTION

The charge transport layer contains, as the active charge transport material, one or more organic photoconductors capable of accepting and transporting charge carriers generated in the charge generation layer. Useful charge transport materials can generally be divided into two classes. That is, most charge transport materials generally will preferentially accept and transport either positive charges, holes, or negative charges, electrons, generated in the charge generation layer.

The polyesters binders for the charge transport layers provided by the present invention can be prepared using well known solution polymerization techniques such as disclosed in W. Sorenson and T. Campbell, Preparative Methods of Polymer Chemistry, page 137, Interscience (1968). Polymers which were evaluated in the standard charge transport layer (CTL) for the described multi-layer photoreceptor were all prepared by means of solution polymerization techniques. Schotten-Baumann conditions were employed to prepare the polyester binders as described below:

Table 1 presents polyesters that are useful.

Table 1

1. poly{4,4'-isopropylidene bisphenylene terephthalate-co-azelate (70/30)}
2. poly{4,4'-isopropylidene bisphenylene terephthalate-co-isophthalate-co-azelate (50/25/25)}
3. poly{4,4'-isopropylidene bisphenylene-co-4,4'-hexafluoroisopropylidene bisphenylene (75/25) terephthalate-co-azelate (65/35)}
4. poly{4,4'-isopropylidene bisphenylene-co-4,4'-hexafluroisopropylidene bisphenylene (50/50) terephthalate-co-azelate (65/35)}
5. poly{4,4'-hexafluoroisopropylidene bisphenylene terephthalate-co-azelate 65/35)}
6. poly{hexafluoroisopropylidene bisphenylene terephthalate-co-isophthalate-co-azelate (50/25/25)}
7. poly{4,4'-isopropylidene bisphenylene isophthalate-co-azelate (50/50)}

The thickness of the charge transport layer may vary. It is especially advantageous to use a charge transport layer which is thicker than that of the charge generation layer, with best results generally being obtained when the charge transport layer is from about 2 to about 200 times, and particularly 10 to 40 times, as thick as the charge generation layer. A useful thickness for the charge generation layer is within the range of from about 0.1 to about 15 microns dry thickness, particularly from about 0.5 to about 6 microns.

The charge generation layer is generally made up of a charge generation material dispersed in an electrically insulating polymeric binder. The charge generation layer may also be vacuum deposited, in which case no polymer is used. Optically, various sensitizing materials such as spectral sensitizing dyes and chemical sensitizers may also be incorporated in the charge generation layer. Examples of charge generation material include many of the photoconductors used as charge transport materials in charge transport layers. Particularly useful photoconductors include titanyltetrafluorophthalocyanine, described in U.S. Pat. No. 4,701,396, bromoindiumphthalocyanine, described in U.S. Pat. No. 4,666,802 and U.S. Pat. No. 4,427,139, the dye-polymer aggregate described in U.S. Pat. Nos. 3,615,374 and 4,175,960, and perylenes or selenium particles described in U.S. Pat. No. 4,668,600 and U.S. Pat. No. 4,971,873. An especially useful charge generation layer comprises a layer of heterogeneous or aggregate composition as described in Light, U.S. Pat. No. 3,615,414 issued Oct. 26, 1971.

Charge generation layers and charge transport layers in elements of the invention can optionally contain other addenda such as leveling agents, surfactants, plasticizers, sensitizers, contrast control agents, and release agents, as is well known in the art.

The multilayer photoconductive elements of the invention can be affixed, if desired, directly to an electrically conducting substrate. In some cases, it may be desirable to use one or more intermediate subbing layers between the conducting substrate to improve adhesion to the conducting substrate and/or to act as an electrical barrier layer between the multi-active element and the conducting substrate as described in Dessauer, U.S. Pat. No. 2,940,348.

Electrically conducting supports include, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film bases such as cellulose acetate, polystyrene, poly(ethylene terephthalate), etc. Such conducting materials as chromium, nickel, etc., can be vacuum deposited on transparent film supports in sufficiently thin layers to allow electrophotographic elements prepared therewith to be exposed from either side of such elements.

In preparing the electrophotographic elements of the invention, the components of the charge generation layer, or the components of the charge transport layer, including binder and any desired addenda, are dissolved or dispersed together in an organic solvent to form a coating composition which is then solvent coated over an appropriate underlayer, for example, a support or electrically conductive layer. The liquid is then allowed or caused to evaporate from the mixture to form the charge generation layer or charge transport layer.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the coating compositions, the optimum ratios of charge generation material or of both charge generation material and charge transport material, to binder can vary widely, depending on the particular materials employed. In general, useful results are obtained when the total concentration of both charge generation material and charge transport material in a layer is within the range of from about 0.01 to about 90 weight percent, based on the dry weight of the layer. In a preferred embodiment of a multiple layer electrophotographic element of the invention, the coating composition contains from about 0 to about 40 weight percent of charge transport agent and from 0.01 to about 80 weight percent of charge generation material.

The initial image forming step in electrophotography is the creation of an electrostatic latent image on the surface of a photoconducting insulator. This can be accomplished by charging the element in the dark to a potential of several hundreds volts by either a corona or roller charging device, then exposing the photoreceptor to an imagewise pattern of radiation that corresponds to the image that is to be reproduced. Absorption of the image exposure creates free electron-hole pairs which then migrate through the charge transport layer under the influence of the electric field. In such a manner, the surface charge is dissipated in the exposed regions, thus creating an electrostatic charge pattern. Electrophotographic toner can then be deposited onto the charged regions. The resulting image can be transferred to a receiver and fused.

EXAMPLES

The following examples are presented to further illustrate the useful mobility of charges through charge transport layers comprising polyesters according to the invention. Comparative examples, using a commercially used polyester binder in the charge transport layers, are presented to show that polyesters according to the invention provide improved charge carrier mobilities.

Comparative Example 1

Prior art polymer A binder in charge transport layer

Electrophotographic elements were prepared using, as a support, 175 micron thick conductive support comprising a thin layer of nickel on poly (ethylene terephthalate) substrate to form an electrically conductive layer. A charge generation layer of amorphous selenium, about 0.3 microns thick, was vacuum deposited over the nickel layer. A second layer (CTL) was coated onto the CGL at a dry coverage of 1.2 g/ft$^2$ with a doctor blade. The CTL mixture comprised 60 wt % poly[4,4'-(2-norbornylidene)bisphenylene terephthalate-co-azelate-(60/40)] (polymer A), 19.75 wt % 1,1-bis-[4-(di-4-tolylamino)phenyl]cyclohexane [CTM 1], 19.5 wt % tri-(4-tolyl)amine [CTM 2], and 0.75 wt % diphenylbis-(4-diethylaminophenyl)methane. The CTL mixture was prepared at 10 wt % in a 70/30 (wt/wt) mixture of dichloromethane and methyl acetate. A coating surfactant, DC510, was added at a concentration of 0.024 wt % of the total CTL mixture.

Polymer A is used in the charge transport layer of many commercially available electrophotographic elements. The solvents 70:30 dichloromethane:methyl acetate, toluene, and 1,1,2-trichloroethane were variously used in the following all of the examples herein. The choice of solvent was found to have little or no effect on the resulting element.

The mobility measurements were made by conventional time-of-flight techniques (Borsenberger and Weiss, Organic Photoreceptors for Imaging Systems, Marcel Dekker Incorporated, N.Y., 1993, page 280). By this method, the displacement of a sheet of holes, created in the α-Se charge generation layer, is time-resolved. The exposures were of 440 nm radiation derived from a dye laser. The exposure duration was 3 ns. The photocurrent transients were measured with a transient digitizer (Tektronix model 2301). The mobilities were determined from the conventional expression $$\mu = L^2/t_0 V,$$

where L is the sample thickness, $t_0$ is the transient time of the photogenerated charge sheet and V is the applied voltage.

The mobilities are shown in Tables 2 and 3.

Example 1

An electrophotographic element was prepared as in comparative example 1, except that the binder was polymer 1, Table 1, and the CTL mixture was prepared at 8 wt % in a 70/30 (wt/wt) mixture of dichloromethane and 1,1,2-trichloroethane. A coating surfactant, DC510, was added at a concentration of 0.024 wt % of the total CTL mixture.

Example 2

An electrophotographic element was prepared as in comparative example 1, except that the binder was polymer 2, Table 1, and the CTL mixture was prepared at 10 wt % in an 80/20 (wt/wt) mixture of dichloromethane and methyl acetate. A coating surfactant, DC510, was added at a concentration of 0.024 wt % of the total CTL mixture.

Example 3

An electrophotographic element was prepared as in comparative example 1, except that the binder was polymer 3, Table 1, and the CTL mixture was prepared at 10 wt % in an 80/20 (wt/wt) mixture of dichloromethane and methyl acetate. A coating surfactant, DC510, was added at a concentration of 0.024 wt % of the total CTL mixture.

Example 4

An electrophotographic element was prepared as in comparative example 1, except that the binder was polymer 4, Table 1.

Comparative Example 2

An electrophotographic element was prepared as in comparative example 1, except that the charge transport material was 40 wt. % CTM 1, and the CTL mixture was prepared at 10 wt. % in dichloromethane.

Comparative Example 3

An electrophotographic element was prepared as in comparative example 2, except that the charge transport material was 40 wt. % CTM 2.

Example 5

An electrophotographic element was prepared as in comparative example 1, except that the binder was polymer 2, Table 1 and the charge transport material mixture was composed of 20 wt. % CTM 1 and 20 wt. % CTM 2. The CTL mixture was prepared at 10 wt. % in a mixture of 80 wt. % dichloromethane and 20 wt. % methyl acetate.

Example 6

An electrophotographic element was prepared as in example 5, except that the charge transport material was 40 wt. % CTM 2.

Example 7

An electrophotographic element was prepared as in example 5, except that the charge transport material mixture was composed of 12.5 wt. % CTM 1 and 12.5 wt. % CTM 2.

Example 8

An electrophotographic element was prepared as in example 5, except that the charge transport material was 25 wt. % of CTM 1.

Example 9

An electrophotographic element was prepared as in example 5, except that the charge transport material was 25 wt. % of CTM 2.

Example 10

An electrophotographic element was prepared as in Example 7, except that the binder is polymer 1, Table 1, and the CTL mixture was made up at 8 wt. % in a 70/30 wt./wt. mixture of dichloromethane and 1,1,2-trichloroethane.

Example 11

An electrophotographic element was prepared as in Example 10, except that the charge transport material was 25 wt. % of CTM 2.

Example 12

An electrophotographic element as prepared in Example 10, except that the binder is polymer 7, Table 1 and the charge transport material mixture was 15 wt. % of CTM 1 and 15 wt. % of CTM 2. The CTL mixture was prepared at a concentration of 10 wt. % in dichloromethane.

Example 13

An electrophotographic element was prepared as in Example 12, except that the charge transport material was 30 wt. % of CTM 1.

Example 14

An electrophotographic element was prepared as in Example 12, except that the charge transport material was 30 wt. % of CTM 2.

TABLE 2

| Example | CTL Polymer Binder* | Mobility ($cm^2/Vs$) | Field (V/cm) |
|---|---|---|---|
| Comparative Example 1 | Polymer A (prior art) | $3.4 \times 10^{-6}$ | $2.5 \times 10^5$ |
| Example 1 | 1 | $7.0 \times 10^{-6}$ | $2.5 \times 10^5$ |
| Example 2 | 2 | $9.7 \times 10^{-6}$ | $2.5 \times 10^5$ |
| Example 3 | 3 | $6.0 \times 10^{-6}$ | $2.5 \times 10^5$ |
| Example 4 | 4 | $6.8 \times 10^{-6}$ | $2.5 \times 10^5$ |

*Numbers in this column refers to Table 1 polymers

The data in Table 2 indicates that the charge transport layers of Examples 1, 2, 3 and 4 showed greater mobilities than the charge transport layer of Comparative Example 1.

At a field of $2.5\times10^5$V/cm, comparative Example 1 containing the binder of the prior art exhibited a mobility of $3.4\times10^{-6}$ $cm^2/Vs$. At the same field strength, utility example containing polymer 2 of Table 1 showed greater mobility, $9.7\times10^{-6}$ $cm^2/Vs$.

TABLE 3

| Example | Binder polymer* | CTM 1 conc. (wt. %) | CTM 2 conc. (wt. %) | Total CTM conc. (wt. %) | Mobility ($\times 10^{-6}$ $cm^2/Vs$) |
|---|---|---|---|---|---|
| Comparative Example 1 | Polymer A | 20 | 20 | 40 | 3.4 |
| Comparative Example 2 | Polymer A | 40 | 0 | 40 | 5.0 |
| Comparative Example 3 | Polymer A | 0 | 40 | 40 | 5.6 |
| Example 5 | 2 | 20 | 20 | 40 | 9.7 |

TABLE 3-continued

| Example | Binder polymer* | CTM 1 conc. (wt. %) | CTM 2 conc. (wt. %) | Total CTM conc. (wt. %) | Mobility ($\times 10^{-6}$ $cm^2/Vs$) |
|---|---|---|---|---|---|
| Example 6 | 2 | 0 | 40 | 40 | 6.5 |
| Example 7 | 2 | 12.5 | 12.5 | 25 | 0.20 |
| Example 8 | 2 | 25 | 0 | 25 | 0.094 |
| Example 9 | 2 | 0 | 25 | 25 | 0.10 |
| Example 10 | 1 | 12.5 | 12.5 | 25 | 0.45 |
| Example 11 | 1 | 0 | 25 | 25 | 0.7 |
| Example 12 | 7 | 15 | 15 | 30 | 0.9 |
| Example 13 | 7 | 30 | 0 | 30 | 0.57 |
| Example 14 | 7 | 0 | 30 | 30 | 0.5 |

*Numbers in this column refers to Table 1 polymers

The mobilities of charge transport materials (CTM) in elements of Polymers A, were higher for charge transport layers containing a single charge transport material than for layers containing a mixture of materials. This is a well recognized phenomenon in the art.

In the case of polymer 2 of Table 1, we observed an exception to the prior art phenomenon, as is illustrated in Table 3. Examine mobilities provided by polymer 2 at 25 percent loading of CTM (compare Example 7 to Examples 8 and 9) or at 40 percent loading of CTM (compare Examples 5 and 6). Both examples show consistently higher mobilities for charge transport material mixtures than for either of the single CTMs. This is novel and unexpected. The prior art teaches that the mobility of carriers in layers containing only one charge transport material will be higher than in the charge transport layer containing a mixtures of charge transport materials.

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

What is claimed is:

1. An electrophotographic element comprising an aggregate charge generation layer and a charge transport layer containing a charge transport material and a polyester binder: wherein (a) the polyester binder is selected from a group consisting of poly{4,4'-isopropylidenebisphenylene terephthalate-co-azelate};

poly{4,4'-isopropylidenebisphenylene terephthalate-co-isophthalate-co-azelate};

poly{4,4'-isopropylidenebisphenylene-co-4,4'-hexafluoroisopropylidene bisphenylene terephthalate-co-azelate};

poly{4,4'-hexafluoroisopropylidenebisphenylene terephthalate-co-azelate};

poly{hexafluoroisopropylidenebisphenylene terephthalate-co-isophthalate-co-azelate} and poly{4,4'-isopropylidenebisphenylene isophthalate-co-azelate}; and (b) the charge transport material is selected from the group consisting of (i) a mixture of tri-tolylamine; 1,1-bis(di-4-tolylamino-phenyl)cyclohexane; and diphenylbis-(4-diethylaminophenyl)methane and (ii) a mixture of 3,3'-(4-p-tolylaminophenyl)-1-phenylpropane and diphenylbis-(4-diethylaminophenyl)methane.

2. The electrophotographic element of claim 1 wherein the polymeric binder is poly{4,4'-isopropylidene bisphenylene-co-4,4'-hexafluoroisopropylidene bisphenylene terephthalate-co-azelate}; and the charge transport material is a mixture of tri-tolylamine; 1,1-bis(di-4-tolylaminophenyl)cyclohexane; and diphenylbis-(4-diethylaminophenyl)methane.

3. The electrophotographic element of claim 1 wherein the polymeric binder is poly{4,4'-isopropylidene bisphenylene-co-4,4'-hexafluoroisopropylidene bisphenylene terephthalate-co-azelate}; and the charge transport material is a mixture of 3,3'-(4-p-tolylaminophenyl)-1-phenylpropane and diphenylbis-(4-diethylaminophenyl) methane.

4. An electrophotographic element according to claim 1 wherein:

(a) the polyester binder is selected from the group consisting of:

poly{4,4'-isopropylidenebisphenylene-co-4,4'-hexafluoroisopropylidene bisphenylene terephthalate-co-azelate};

poly{4,4'-hexafluoroisopropylidenebisphenylene terephthalate-co-azelate} and poly{hexafluoroisopropylidenebisphenylene terephthalate-co-isophthalate-co-azelate}.

* * * * *